United States Patent [19]

Smith

[11] 4,164,723

[45] Aug. 14, 1979

[54] SHUNT RELEASE AND LOCKING STRUCTURE

[75] Inventor: Leonard S. Smith, Eden Valley, Minn.

[73] Assignee: Century Mfg. Co., Minneapolis, Minn.

[21] Appl. No.: 915,174

[22] Filed: Jun. 14, 1978

[51] Int. Cl.[2] ..... H01F 21/06

[52] U.S. Cl. ..... 336/133

[58] Field of Search ..... 336/45, 132, 133, 134, 336/135, 130

[56] References Cited

U.S. PATENT DOCUMENTS

| | | | |
|---|---|---|---|
| 2,091,366 | 8/1937 | Klinkhamer | 336/133 X |
| 4,107,635 | 8/1978 | Brundage et al. | 336/133 X |

*Primary Examiner*—Thomas J. Kozma

*Attorney, Agent, or Firm*—Leo Gregory

[57] ABSTRACT

This invention is in connection with a sliding shunt type of welder wherein the improvement consists of a shunt being released positioned and secured relative to the core of the welder by a single hand action of the operator, the shunts being carried by a pair of channel members connected by a frame member, the channel members being slideable in a track moveable into and out of operative relationship with said core and with one of the channel members having movement relative to the other channel member and being spring pressed into a normal locked position and with this channel member being released by the squeezing of a handle carried by the frame which retracts the spring bearing against the one channel member and frees both channel members for movement in the track relative to the core by a simple squeezing hand action of the operator.

8 Claims, 4 Drawing Figures

100
90
80
60
50
40
25
ON
OFF
18
120
12
22
24
14
20
60
10
113
115
85a
85b
90
93
95
85
98
80
97
70
106
103
105
100
112
117
110
65
69
79
C'
87
68
37
28
75
38
32
C
16
30
65
75
14
122
20

SHUNT RELEASE AND LOCKING STRUCTURE

BACKGROUND AND SUMMARY OF THE INVENTION

1. Field of the Invention

This invention relates to the shunt adjustment of moveable shunt type of welders.

2. Description of the Prior Art

The known related art consists of the following U.S. Pats., namely, No. 3,394,332 to C. E. Peterson wherein the shunt is moveable by a rod linkage and secured by rotation of the rod bearing against the housing; No. 3,510,815 to R. H. Jackman wherein the shunts are moveable on rails by a lower arm and are locked by rotation of a knob bearing against the housing; No. 3,514,732 to R. H. Jackman which consists of a rod linkage having a shunt and the same being locked by a knob bearing against the housing; No. 3,914,726 which shunt is moved by a rod linkage and locked by the rod being cocked in an outer center position and No. 4,086,551 to Leonard S. Smith in which the shunt is slidably moved by an operating rod which by rotation is placed in locked or unlocked position. The improvement herein consists of a single hand action, simply that of squeezing a spring operating lever carried by a handle.

SUMMARY OF THE INVENTION

This invention relates to a moveable shunt type of welder in which shunts in spaced relation are carried in a pair of channel members slidable in a rail at each side of the core and having a common connecting frame member, one of said channel members being secured to said connecting frame member to have movement relative to the other channel member, a spring member carried by said connecting frame member bearing against said one of said channel members, a rod running from the end of said spring bearing against said channel member to a squeeze handle member extending outwardly of the housing of the welder, said handle member having a pivoted angle portion to which said rod is connected whereby movement of said pivoted portion of said handle member draws said rod in a direction to relieve the pressure of said spring against said one of said channel members whereby said channel member has freedom of movement in its adjacent rail and the other of said channel members has a corresponding freedom of movement in its adjacent rail whereby upward or downward movement of said handle member readily adjusts the position of said shunts relative to said core.

This and other objects and advantages of the invention will be set forth in the following description made in connection with the accompanying drawings in which like reference characters refer to similar parts throughout the several views.

DESCRIPTION OF A PREFERRED EMBODIMENT

Figures 1, 2:
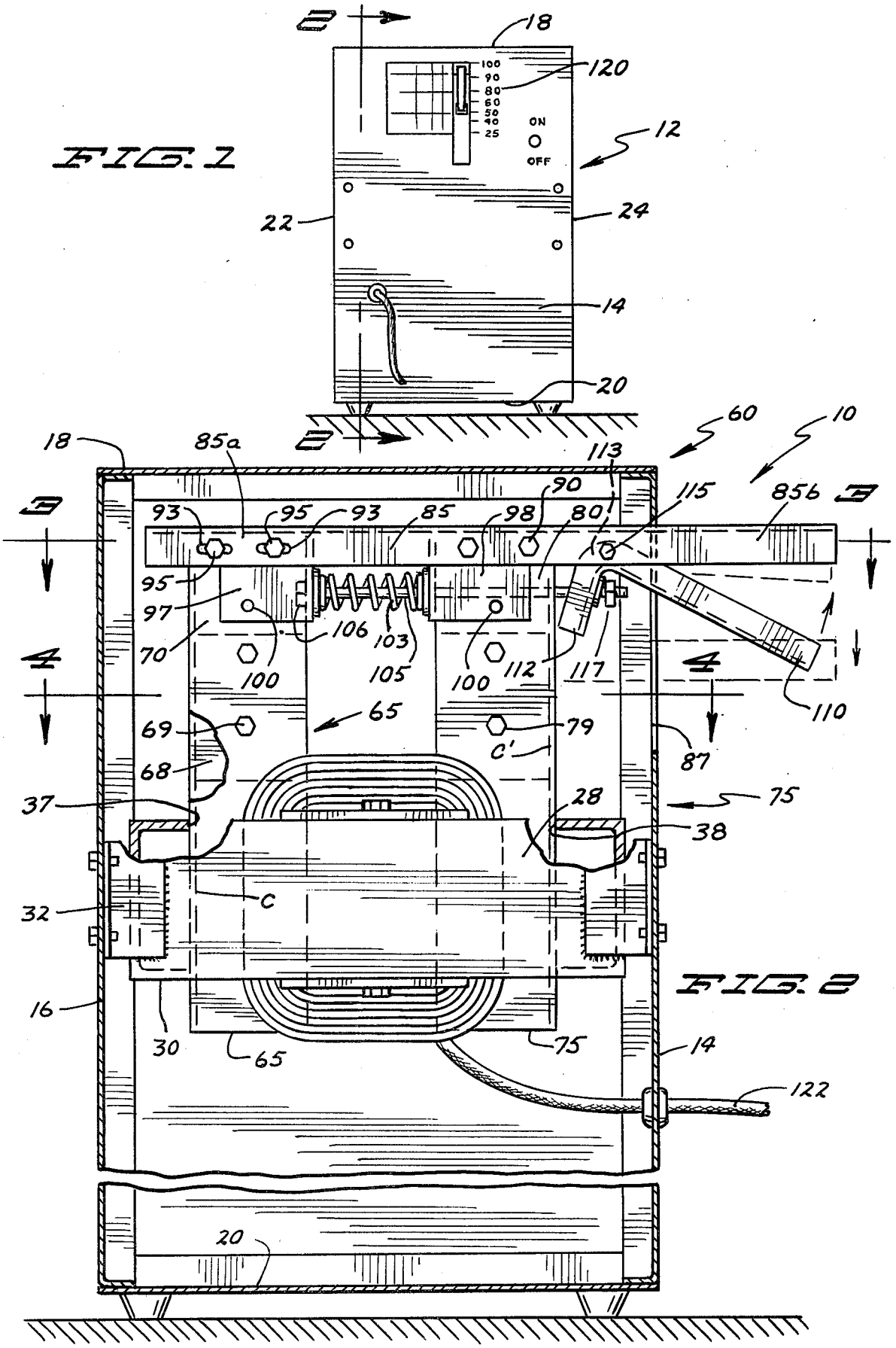
FIG. 1 is a view in front elevation.
FIG. 2 is a view on an enlarged scale in vertical section taken on line 2—2 of FIG. 1 as indicated.
Figure 3:
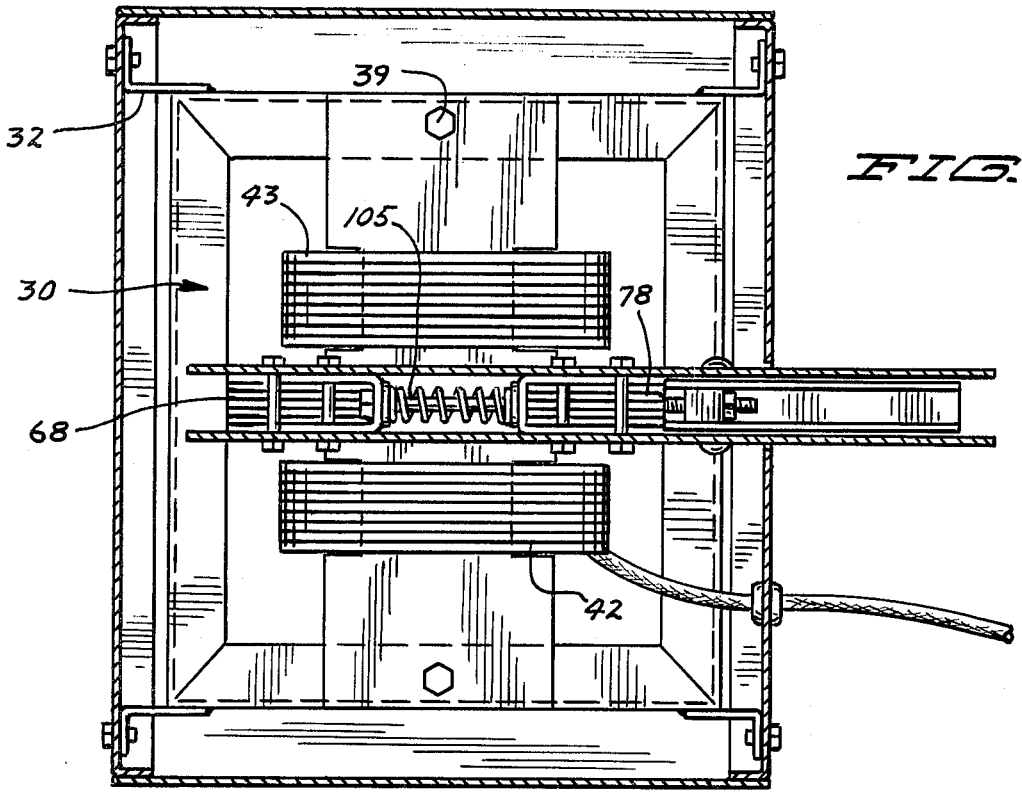
FIG. 3 is a view in horizontal section taken on line 3—3 of FIG. 2 as indicated.

Referring to the drawings, a moveable shunt type of welding structure 10 is shown comprising a housing 12 here indicated as being substantially parallelepiped in form having front and rear walls 14 and 16, top and bottom walls 18 and 20 and side walls 22 and 24.

Figure 4:
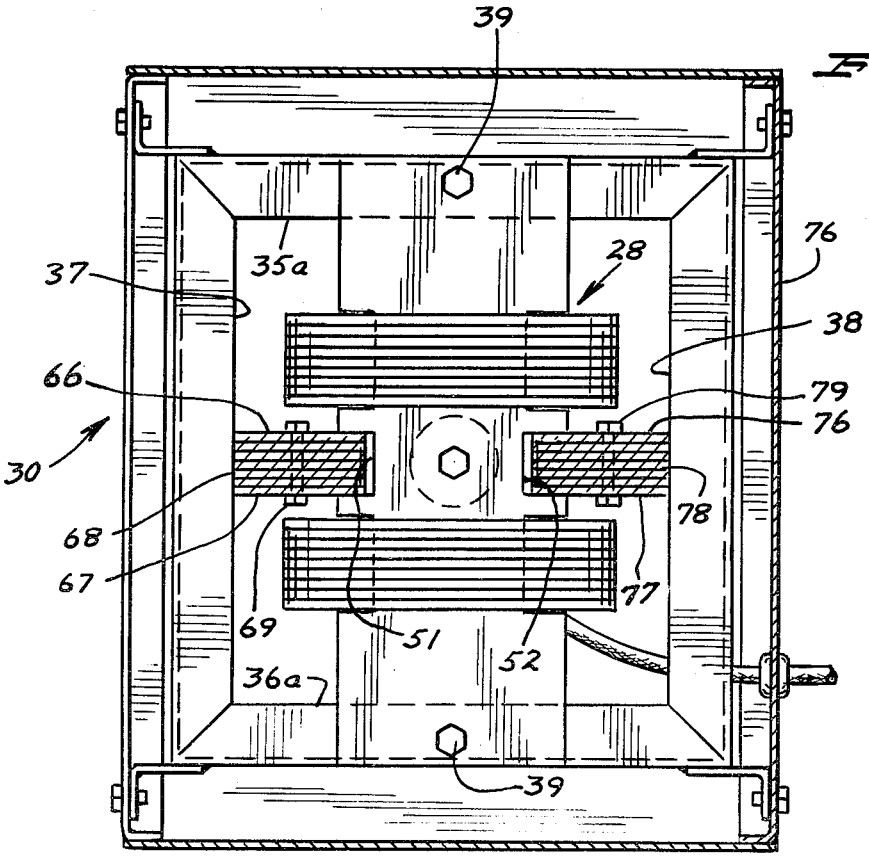
FIG. 4 is a view in horizontal section taken on line 4—4 of FIG. 2 as indicated.

With particular reference to FIG. 2, a core 28 of a conventional structure is secured to an encircling angled frame member 30 which is suitable secured to said front and rear walls of said housing by bolted brackets such as bracket 32. The end walls 35 and 36 of said frame have flanges or lands **35*a* and 36*a* supporting the adjacent ends of said core, the same being secured by bolts 39 as indicated in FIG. 4**.

Said core in a conventional manner carries therein a pair of spaced primary and secondary coils 42 and 43 and formed in said core between said rails in the outer walls of said core are a pair of open faced aligned grooves 51 and 52 forming vertical rails.

In connection with said core is a shunt carrying and locking structure 60 which comprises the essential structure of the invention herein.

Said structure 60 is shown consisting of a pair of shunt holding members 65 and 75.

Shunt holding member 65 is formed of a pair of transversely spaced parallel plate members 66 and 67 having a shunt member 68 secured therebetween as by rivets 69. Said shunt member is positioned at the upper portion of said plate members as indicated in FIG. 2. In alignment with said shunt holding member 65 is shunt holding member 75 of like construction comprising spaced plate members 76 and 77 and having a shunt member 78 secured therebetween by rivets 79.

Said shunt holding members are of a thickness to be respectively disposed within said rails 51 and 52 and have a width such as to extend outwardly of said rails oppositely of one another. The width of said shunt holding members will be such that each of said shunt holding members will have just sufficient clearance for vertical movement between their respective rails and the respective adjacent walls 37 and 38 of said frame member 30 as indicated in FIG. 2.

Overlying and receiving therein the top end portions 70 and 80 of said shunt holding members is an elongated U-channel member 85 which extends outwardly of the front wall of said housing through a vertical slot 87 formed therein. The shunt holding member 75 is rigidly secured to said channel member by spaced bolts or rivets 90. The portion **85*a* of said channel member 85 overlies the shunt holding member 65 and has a pair of horizontally spaced slots 93 therein through which bolts or rivets 95 are disposed to secure said shunt holding member. Thus it is seen that shunt holding member 65 has movement relative to said channel member 85 in directions toward and away from said shunt holding member 75. A pair of U-channel brackets 97 and 98 in opposed relation are respectively disposed over the adjacent facing portions of said shunt holding members as shown in FIG. 2 and the same are secured by rivets 100. Disposed between said brackets under tension is a coil spring 103. A rod 105 extends axially through said spring and is secured by a nut 106 at one end thereof within said bracket 97 and the other end of said rod extends outwardly through said shunt holding member 75 between the spaced plate portions thereof as illustrated in FIG. 2**.

In cooperative relationship with the portion of said channel member 85 and the handle portion 85*b* thereof extending outwardly of said housing 12 is an angled channel member 110 having a depending leg portion 112 disposed within said housing between said shunt holding member 75 and said front wall 14 and the same has the angle portion 113 thereof received within said channel member and pivoted therein by a bolt or rivet 115 with said leg portion depending sufficiently to have the adjacent end of said rod disposed therethrough and secured thereto as by a nut 117.

Said slot 87 has a length such that with channel member 85 and the shunt holding members 65 and 75 in the raised position shown in FIG. 2, the shunt members 68 and 78 will be positioned above and outwardly of the core 28 and when lowered as will be described, the slot will permit downward movement to the point that the shunt members will be fully within the rails of said core and at which point the shunt holding members will engage as a stop member the bottom wall of said housing.

Said slot 87 as seen on the front wall 14 has indicia 120 indicating welding current output for the purpose of positioning the shunt members accordingly.

OPERATION

The significant improvement present in the above described device is present in the structure of the handle member 85*b* with the trigger or lever portion 110 thereof whereby the operator with the closing of one hand moving the trigger portion upwardly causes the spring 103 to come under compression sufficiently to be withdrawn from bearing against the shunt holding member 65 which in turn frees said shunt holding member 65 and as a consequence the shunt holding member 75, whereby said shunt holding members together with the connecting channel member 85 can be readily lowered or raised to position as may be desired the shunt member 68 and 78 with respect to the core 28. This is a very simple one handed operation whereby merely gripping together the handle portion 85*b* of the member 85 and the lever portion 110, adjustment is readily made by raising and lowering said handle member and upon opening of the hand the shunts are automatically in locked position.

The amount of clearance necessary for the free movement upwardly and downwardly of the shunt holding members in the rails 51 and 52 is a very small clearance and this is indicated by dotted lines C and C′ in FIG. 2.

Thus it is seen that the applicant has provided a very efficiently operated positive holding means for quick shunt adjustment.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A shunt release and locking structure for a moveable shunt welding machine, having in combination a core, a frame member supporting said core, a pair of shunt holding members containing shunts disposed between opposed sides of said core and the adjacent portions of said frame member, a handle member holding said shunt holding members in spaced relation, means normally causing said shunt holding members to bear against said adjacent portions of said frame member in locking engagement, a lever pivotally carried by said handle having said means connected thereto, whereby a hand closing action about said handle and said lever causes said means to release said shunt holding members from said locking engagement.

2. The structure set forth in claim 1, wherein said core has a groove at each of its said opposed sides partially receiving said shunt holding members therein, and said grooves being disposed substantially centrally transversely of said core.

3. The structure set forth in claim 1, wherein said means comprises a coil spring under compression between said shunt holding members, and one of said shunt holding members having movement toward and away from the other of said shunt holding members.

4. The structure set forth in claim 1, wherein said means comprises a coil spring under compression between said shunt holding members bearing against the same, a rod having said spring mounted thereon, said rod extending to and being secured to said lever carried by said handle, one of said pair of said shunt holding members being moveable toward and away from the other of said pair of said holding members, whereby, movement of said lever causes the retraction of said spring.

5. The structure set forth in claim 4, wherein said lever comprises an angled latch operating member, and means pivoting said lever to said handle.

6. The structure set forth in claim 1, wherein said handle member comprises an elongated member, means securing said shunt holding members to said handle member, and one of said pair of said shunt holding members having movement relative to said handle member in a direction toward and away from the other of said pair of said shunt holding members.

7. the structure set forth in claim 1, wherein said core is disposed within a housing, said handle member has a handle holding portion extending outwardly of said housing, a slot in said housing for movement of said handle and shunt holding members, whereby the shunts carried by said shunt holding members are moved in the direction of and away from said core.

8. A shunt release and locking structure for a moveable shunt holding machine, having in combination a housing, a core disposed in said housing, a frame within said housing supporting said core, said core having a pair of spaced coils, a groove at each side of said core spaced between said coils and extending transversely of said core, a shunt holding member containing a shunt partially disposed in each of said grooves, a handle member having said shunt holding members secured thereto, one of said shunt holding members having movement relative to said handle member in the direction of and away from the other of said shunt holding members, means disposed between said shunt holding members causing said shunt holding members to bear in locking engagement against the portions of said frame member adjacent thereto, means in connection with said last mentioned means causing the same to be retracted from bearing against said shunt holding members, said housing having a slot therein, a portion of said handle member extending outwardly of said slot and of said housing, an angled lever carried by said handle having said last mentioned means secured thereto, whereby a hand closing about said handle and said lever member causes said last mentioned means to retract said first mentioned means and release said shunt holding members from locking engagement with said adjacent portions of said frame member, and said slot having a length such that said handle moves said shunts relative to said core.

* * * * *